US008333336B2

(12) United States Patent
Lewis et al.

(10) Patent No.: US 8,333,336 B2
(45) Date of Patent: Dec. 18, 2012

(54) CAVITATION EROSION REDUCTION STRATEGY FOR VALVE MEMBER AND FUEL INJECTOR UTILIZING SAME

(75) Inventors: Stephen R. Lewis, Chillicothe, IL (US); Dana R. Coldren, Secor, IL (US); Jeffrey J. Mueller, Bloomington, IL (US); Victor Yacoub, Washington, IL (US)

(73) Assignee: Caterpillar Inc., Peoria, IL (US)

( * ) Notice: Subject to any disclaimer, the term of this patent is extended or adjusted under 35 U.S.C. 154(b) by 908 days.

(21) Appl. No.: 11/714,697

(22) Filed: Mar. 6, 2007

(65) Prior Publication Data

US 2008/0217421 A1 Sep. 11, 2008

(51) Int. Cl.
*B05B 1/30* (2006.01)

(52) U.S. Cl. ..... 239/585.1; 239/585.5

(58) Field of Classification Search ..... 239/89, 239/91, 95, 585.1, 585.3, 585.4, 585.5, 533.2, 239/584; 251/129.15, 129.21, 127
See application file for complete search history.

(56) References Cited

U.S. PATENT DOCUMENTS

| | | | | |
|---|---|---|---|---|
| 4,653,455 | A | 3/1987 | Eblen et al. | |
| 4,889,163 | A | 12/1989 | Engelbertsson | |
| 5,018,703 | A | 5/1991 | Goode | |
| 5,683,228 | A | 11/1997 | Beatty | |
| 5,823,446 | A * | 10/1998 | Bennett et al. | 239/585.1 |
| 5,934,643 | A * | 8/1999 | Cooke | 251/129.01 |
| 6,113,014 | A * | 9/2000 | Coldren et al. | 239/585.1 |
| 6,422,265 | B1 | 7/2002 | Beyer et al. | |
| 6,582,209 | B2 | 6/2003 | Rodriguez-Amaya | |
| 6,834,845 | B2 | 12/2004 | Finke et al. | |
| 2002/0073966 | A1 | 6/2002 | Rodriguez-Amaya | |
| 2004/0217206 | A1 | 11/2004 | Dong et al. | |

FOREIGN PATENT DOCUMENTS

| | | |
|---|---|---|
| DE | 520187 | 3/1931 |
| FR | 2817296 | 5/2002 |
| GB | 1260415 | 1/1972 |

OTHER PUBLICATIONS

Pending publication of U.S. Appl. No. 11/478,318, filed Jun. 29, 2006; Tian et al.; Inlet Throttle Controlled Liquid Pump With Cavitation Damage Avoidance Feature.

* cited by examiner

*Primary Examiner* — Davis Hwu
(74) *Attorney, Agent, or Firm* — Liell & McNeil

(57) ABSTRACT

A mechanically actuated electronically controlled unit injector includes an electronically controlled spill valve to precisely control timing of fuel pressurization within a fuel pressurization chamber. Cavitation bubbles may be generated in the region of the valve seat when the spill valve member is closed to raise fuel pressure in the fuel injector. This cavitation can cause erosion on the spill valve member and the surrounding injector body. In order to preempt cavitation damage, the valve member may be modified to include a compound annulus that includes a small annulus that corresponds to an identified cavitation damage pattern. Although the generation of cavitation bubbles may continue after such a strategy, cavitation erosion, and the associated liberation of metallic particles into the fuel system can be reduced, and maybe eliminated, by the preemptive cavitation reduction strategy.

13 Claims, 2 Drawing Sheets

(previous design)

(previous design)

CAVITATION EROSION REDUCTION STRATEGY FOR VALVE MEMBER AND FUEL INJECTOR UTILIZING SAME

TECHNICAL FIELD

The present disclosure relates generally to a cavitation erosion reduction strategy in a fuel injector, and more particularly to a valve member of a fuel injector incorporating the cavitation erosion reduction strategy.

BACKGROUND

Most fuel injectors include one or more electronically controlled valves that open and close various fuel passageways to facilitate control over fuel injection events. One class of such fuel injectors is typically identified as a mechanically actuated, electronically controlled unit injector (MEUI) which utilize an electronically controlled valve to precisely control a timing at which fuel in the fuel injector becomes pressurized. In particular, a rotating cam periodically advances a plunger to pressurize fuel in a fuel pressurization chamber, but pressure does not rise until a spill valve is closed. If a spill valve is closed during a plunger stroke, fuel pressure quickly rises followed by opening of a nozzle outlet to perform an injection event. A spill valve for such an injector is shown, for example in co-owned U.S. Pat. No. 6,349,920. Later evolutions of the MEUI fuel injector added a second electronically controlled valve to control the opening and closing of the nozzle outlet somewhat independently of the fuel pressurization event accomplished through the spill valve.

The phenomenon known as cavitation can sometimes arise at unexpected locations within a fuel injector. Furthermore, cavitation damage can in some cases potentially lead to premature fuel injector failure rather than simple wear and tear on the various inner surfaces defining the fuel passageways through the fuel injector. One common location where fuel injectors receive cavitation damage is on the valve members. The collapse of cavitation bubbles may eventually erode an annular surface on the valve member and may affect its operation, the operation of the fuel injector, and the operation of the engine. Cavitation erosion is also undesirable because it produces small metallic particles that can cause scuffing and seizure in moving parts of a fuel system.

Unfortunately, modeling fluid systems to predict the occurrence of cavitation, as well as potential magnitudes of damage and their respective locations due to cavitation has proven to be extremely difficult. Thus, a computer aided design strategy for avoiding some cavitation damage problems is not realistic as the modeling tools available to simulate various different design shapes and evaluate the same for potential cavitation damage are not capable of accurately and reliably predicting some cavitation damage problems. Thus, engineers are sometimes left with exploiting simple trial and error in various design alternatives in order to address potential cavitation damage issues.

The present disclosure is directed to overcoming one or more of the problems set forth above.

SUMMARY OF THE INVENTION

In one aspect, a fuel injector includes an injector body with a fuel passage disposed therein that is partly defined by an annular valve seat. An electronically controlled valve includes a valve member with an annular valve surface that moves into and out of contact with the annular valve seat to close and open the fuel passage, respectively. The annular valve surface defines a portion of the compound annulus defined by the valve member.

In another aspect, a valve member for a fuel injector control valve comprises a unitary metallic body with a threaded bore therethrough concentric with a cylindrical outer surface. A compound annulus is defined by the cylindrical outer surface. A portion of the compound annulus is also defined by an annular valve surface, which is a portion of the cylindrical outer surface.

In still another aspect, a method of reducing cavitation erosion in a fuel system includes operating a fuel injector over a sufficient number of injection cycles to detect cavitation damage in a valve member of an electronically controlled valve of the fuel injector. A cavitation damage pattern is identified on the valve member. A new valve member is formed identical to the valve member in a region corresponding to the cavitation damage pattern, except the new valve member defines an additional annulus corresponding to the cavitation damage pattern.

DETAILED DESCRIPTION

Figure 1:
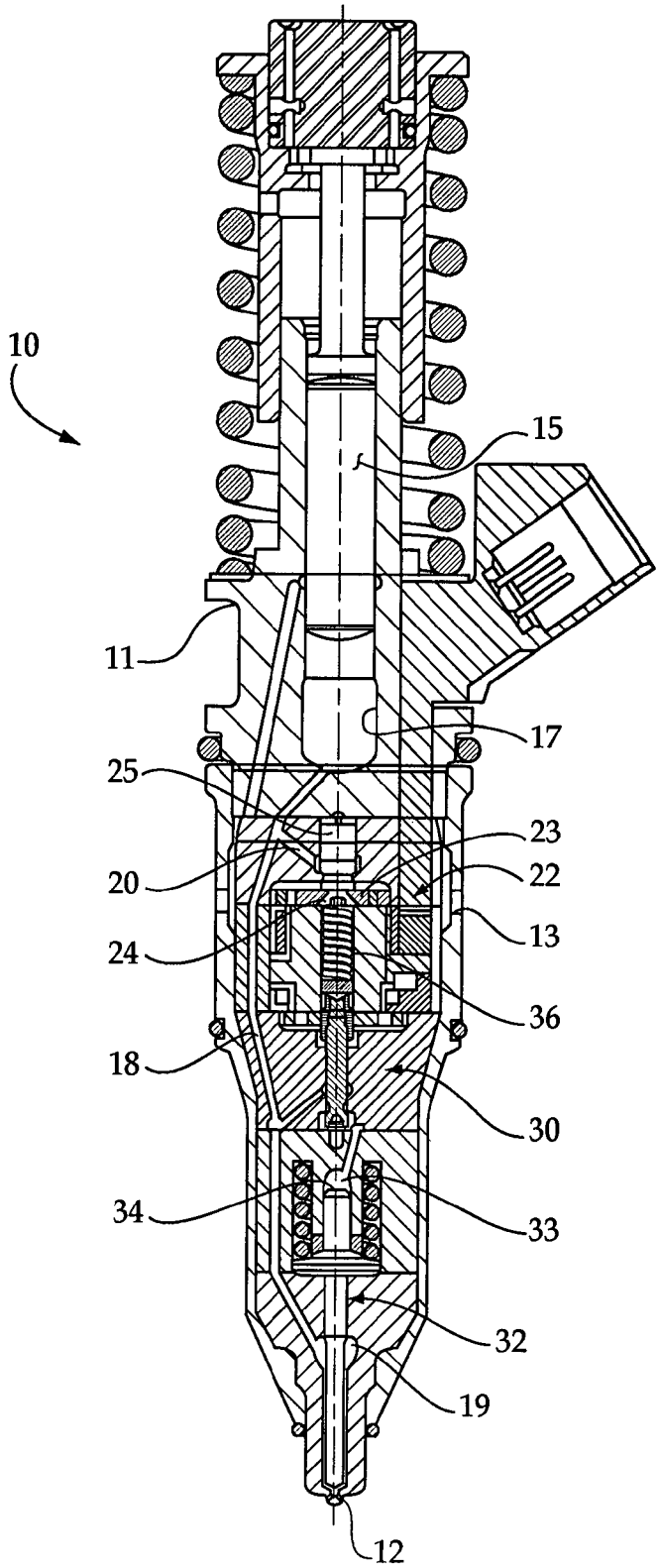
FIG. 1 is a side sectioned diagrammatic view of a fuel injector according to one aspect of the present disclosure.

Referring to FIG. 1, fuel injector 10 includes an injector body 11 that defines a nozzle outlet 12 and a fuel inlet/return opening 13. A cam driven plunger 15 is positioned to move in the injector body 11 to displace fuel into fuel passage 18, which is disposed in injector body 11. A fuel spill passage 20 is disposed in injector body 11 and extends between fuel passage 18 and supply/return opening 13. An electronically controlled spill valve 22 includes a valve member 25 with an annular valve surface 43 (FIG. 2) that moves into and out of contact with an annular valve seat 29 to close and open spill passage 20. The valve member 25 includes a threaded bore 40 extending therethrough that is concentric with the annular valve surface 43. A solenoid armature 23 is attached to valve member 25 via a threaded fastener 24 that is mated to threads 40 of valve member 25 via a set of external threads 41. Thus, when plunger 15 is being driven downward to pressurize fuel in fuel pressurization chamber 17, the fuel may be initially displaced back through supply/return opening 13 via spill passage 20. When electronically controlled valve 22 is energized to move annular valve surface 43 into contact with annular valve seat 29, spill passage 20 becomes closed, and fuel pressure in chamber 17, and hence nozzle chamber 19, quickly rises to injection pressure levels.

Fuel injector 10 also includes an electronic needle control valve 30 that fluidly connects or disconnects a needle control chamber 33 to fuel passage 18. This electronic needle control valve 30 includes a solenoid separate from the electronically controlled spill valve 22. During an injection event, needle control chamber 33 is fluidly connected to fuel passage 18, pressure on closing hydraulic surface 34 of direct control needle valve 32 is high and the nozzle 12 is maintained closed. When electronic needle control valve 30 is moved to close that fluid connection, pressure in needle control chamber 33 drops via a fluid connection (not shown) to supply/return opening 13, allowing direct control needle valve 32 to lift to open nozzle outlet 12, provided fuel pressure in nozzle chamber 19 is sufficient to overcome a needle biasing spring in a manner well known in the art.

Figure 2:
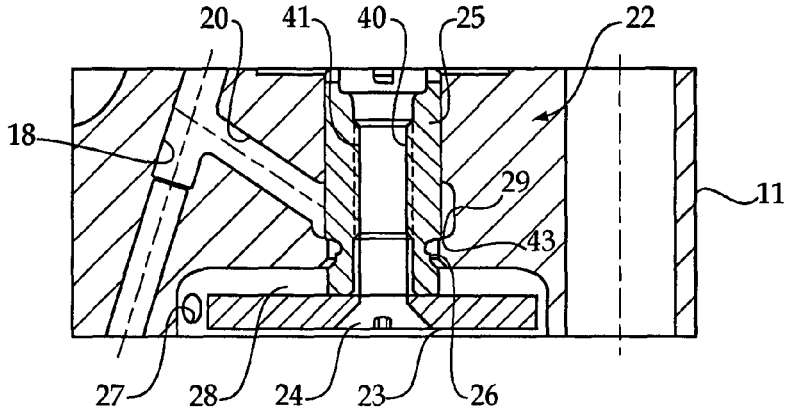
FIG. 2 is an enlarged partial view of the spill valve portion of the fuel injector of FIG. 1.

FIG. 2 shows valve member 25 in its downward closed position where annular valve surface 43 is in contact with annular valve seat 29 to close spill passage 20. When the solenoid is de-energized, a biasing spring 36 acts on armature 23 to push valve member 25 upward to open annular valve seat 29. When this occurs, spill passage 20 is fluidly connected to supply/return opening 13 via compound annulus 26, armature chamber 28 and low pressure passage 27. Compound annulus 26 is defined by valve member 25, which is preferably a unitary metallic body. In the context of the present disclosure, a compound annulus means a smaller volume annulus that opens into a larger volume annulus. Also, as shown in the drawings and to make explicit what is already implicitly clear, the term "annulus" means an annular void. Thus, an injection event is typically initiated during downward movement of plunger 15 by energizing electronically controlled spill valve 22 to close annular valve seat 29. The fuel injection event is then commenced by moving electronic needle control valve 30 to a position that relieves pressure in needle control chamber 33. An injection event may be ended either by repressurizing needle control chamber 33, or by relieving fuel pressure in nozzle chamber 19 by reopening spill control valve 22.

Figure 4:
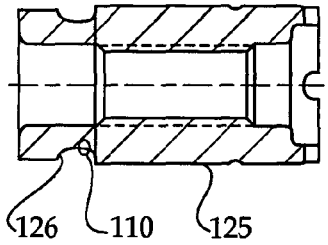
FIG. 4 is a sectioned side view of a cavitation damage prone valve member.
Figure 6:
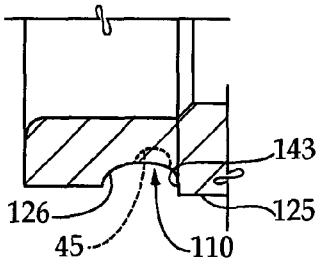
FIG. 6 is an enlarged view of the cavitation damage region of the cavitation damage prone valve member.

Referring now to FIGS. 4 and 6, a valve member 125 according to a first embodiment includes a single large annulus 126 that is defined in part by annular valve surface 143. Although this design performs well with regard to cavitation, there is always room for improvement. After many hours of operation involving many injection cycles, it is possible that cavitation that may occur around valve member 125 may begin to erode annulus 126 at location 110 (which is on the low pressure side of the circuit) according to pattern 111. The cavitation bubbles that occur around valve member 125 are believed to develop shortly after the closing of annular valve seat 29. When this occurs, the momentum of the fluid spilling through spill passage 20 is believed to have a water hammer effect, in that a vacuum develops adjacent to valve seat 29, and flow conditions cause at least some of the cavitation bubbles to collapse adjacent to the valve member 125 at location 110. Over time, it is possible that the continuous collapsing of the cavitation bubbles may begin to erode valve member 125. If the erosion were to continue over time, the erosion could eventually break through into threaded bore 40 leaving the electronic control spill valve less able to completely close spill passage 20 to allow fuel pressure to develop in the fuel injector. As a result, that injector could be unable to inject fuel and the associated engine cylinder might go cold.

In order to both minimize the amount of debris set loose in the fuel system due to cavitation erosion and to minimize the likelihood of cavitation erosion in the first place, the present disclosure contemplates a rather counterintuitive solution. In particular, the present disclosure teaches that by adding an annulus, such as annulus 45 in the vicinity of, and with a magnitude (shape and volume) associated with the potential cavitation erosion pattern 111 illustrated in FIG. 6, cavitation erosion may be reduced, and potentially actually avoided. In other words, it is believed that by preemptively removing material that might otherwise be eventually eroded via cavitation, flow patterns around the valve member may change such that either the cavitation bubbles no longer are generated, or that they collapse at a location away from the valve member to minimize the likelihood of erosion in the relevant locations or cause any erosion that may occur to occur on a less critical surface within the fuel injector 10. Thus, based on conventional wisdom, which might suggest that the preemptive addition of an annulus corresponding to a potential cavitation erosion pattern 111 might actually hasten cavitation erosion, the cavitation erosion minimization strategy disclosed in the present disclosure actually provides a surprising result. Other potential solutions, such as lengthening annulus 26 or changing the contours of the same, may also be possible, but are believed to be less successful at reducing the likelihood of cavitation erosion. Factors that may influence the degree of minimization of the likelihood of cavitation erosion may include the location and size of the additional small annulus 45. Since no reliable modeling tools for predicting the likelihood of cavitation erosion in relatively complex fluid flow environment of a spill valve of a fuel injector is known to exist, some experimentation in finding a solution may be necessary. The present disclosure teaches that a good place to start in finding an alternative shape to a valve member to minimize the likelihood of cavitation erosion in a particular area is to actually preemptively add an annulus 45 (remove material relative to a previous design of the valve member) corresponding to a potential cavitation erosion pattern 111. Thus, in a valve member according to a second embodiment of the present disclosure, the valve member 25 includes a compound annulus 26 with a small annulus 45 that opens into a large annulus 44.

Figure 3:
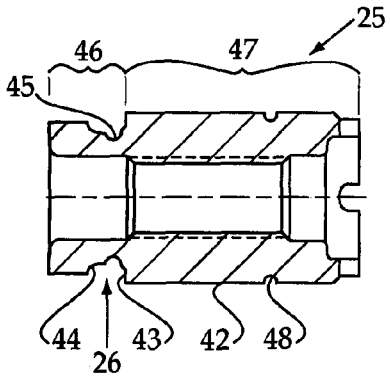
FIG. 3 is a sectioned side elevational view of the valve member for the spill valve portion of FIG. 2.
Figure 5:
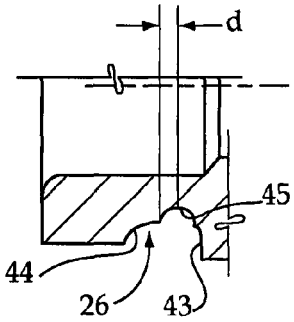
FIG. 5 is an enlarged view of the compound annulus portion of the valve member of FIG. 3.

Referring now to FIGS. 3 and 5, valve member 25 according to the second embodiment includes a symmetrical cylindrical outer surface extending along its length with various contours that include a large diameter segment 47 adjacent a small diameter segment 46. Compound annulus 26 is located in small diameter segment 46, and annular valve surface 43 is located at the transition from small diameter segment 46 to large diameter segment 47. An additional annulus 48 is located in the large diameter segment 47, which is longer than the small diameter segment 46. As best shown in FIG. 5, the small annulus 45 is offset a distance d from the center of large annulus 26, but not so far that the small annulus 45 shares a common wall segment with the surface defining annular valve surface 43. According to one exemplary embodiment, the small annulus 45 has a U shaped cross section, which may be semicircular, having proportions as illustrated in FIG. 5. However, those skilled in the art will appreciate that the location, shape and size of small annulus 45 could be varied to achieve satisfactory results.

INDUSTRIAL APPLICABILITY

The teachings of the present disclosure are directed toward making a valve member that reduces the likelihood of erosion caused by cavitation. The present disclosure finds potential application in any fuel injector that exhibits, or is likely to exhibit, cavitation erosion on an outer surface of a valve member. The present disclosure finds specific application in reducing the likelihood of cavitation erosion on a spill valve member of a mechanically actuated electronically controlled unit injector. Thus, the present disclosure is also directed to reducing the likelihood of introducing metallic debris in a fuel system, which can cause scuffing and seizures of moving parts. The present disclosure recognizes that issues relating to cavitation erosion are often difficult to predict with currently available modeling tools, and thus are most often discovered after a fuel injector has been put into production and has performed over many hours and possibly millions of injector cycles. Thus, the present disclosure may also relate to a case where a fuel injector has been operated for a sufficient number of injection cycles to detect cavitation erosion on a valve member of an electronic controlled valve of a fuel injector. Once the occurrence of cavitation erosion is noticed, a cavitation erosion pattern 111 on the valve member 125 can be identified. For instance, this can be accomplished by operating a plurality of fuel injectors over a sufficient number of hours to reveal an expected magnitude and variation in the cavitation erosion pattern among the valve members for the plurality of fuel injectors. An alternative valve member design may be made that is substantially identical to the previous design valve member in a region corresponding to the cavitation erosion pattern or likely cavitation erosion pattern, except the new valve member defines an additional annulus corresponding to the cavitation erosion pattern. The term "corresponding" in this case refers to the notion that the additional annulus is located where the cavitation erosion pattern is identified or likely, and the size and shape of the additional annulus may be related to an average cavitation erosion observed over some period of time. In other words, adding an additional annulus that is too small, or too large, may not have an impact on the likelihood of cavitation erosion or the actual cavitation erosion experienced. In addition, mislocating the added small annulus may also lead to a situation where there is little or no affect on the likelihood of cavitation erosion or on the experience cavitation erosion.

Once a cavitation erosion pattern 111 has been identified, the present disclosure would suggest that a first attempt at finding a solution would be to form new valve members having an additional annulus with different combinations of cross sectional shape, volume and location at the cavitation erosion location 110. Then, new fuel injectors with the new valve member should be operated on the order of a number of hours corresponding to when the cavitation erosion started or was likely to start on the previous version of the valve members. Those skilled in the art will recognize that conditions more favorable to cavitation can be created by elevating the fluid temperature. This can hasten the iteration process in finding a suitable design alternative. The new valve members would then be sorted according to a cavitation erosion criteria. For instance, some of the new valve members may show no evidence of cavitation erosion, some may show frosting as to some limited cavitation erosion and others may show cavitation erosion more severe even than the unmodified previous design valve members. Utilizing this technique, in one or two or more iterations as needed, should allow one to arrive at an additional annulus shape, location and volume that sufficiently reduces the cavitation erosion issue such that one could expect the valve member to exhibit over a performance lifetime on the order of that expected from the other components of the fuel injector. In other words, a fuel injector with a modified or new valve member with an added annulus could expect to have an extended life relative to the earlier version, which could mean that during a remanufacturing process, the valve would not have to be replaced when other parts of fuel injector would.

In the specific case where the cavitation erosion occurs or has the potential to occur in an already existing annulus, the present disclosure teaches that the additional small annulus 45 may added to open into the large annulus 44 to result in a compound annulus 26 that substantially reduces or eliminates the likelihood of cavitation erosion. While the disclosed cavitation reduction strategy may not lead to the elimination of cavitation bubbles, the strategy may result in a changing of flow patterns in the effected region to result in cavitation bubbles being collapsed at a location where some erosion is more acceptable or collapse at a location that does not, or is less likely to, produce cavitation erosion. In the case of the present disclosure, a U-shaped small annulus 45 having a semicircular cross section may be added at a location corresponding to a potential cavitation erosion pattern 111 at a location offset from the center of the large annulus 44.

It should be understood that the above description is intended for illustrative purposes only, and is not intended to limit the scope of the present invention in any way. Thus, those skilled in the art will appreciate that other aspects of the invention can be obtained from a study of the drawings, the disclosure and the appended claims.

What is claimed is:

1. A fuel injector comprising:

an injector body with a fuel passage disposed therein that is partly defined by an annular valve seat;

an electronically controlled valve that includes a valve member with an annular valve surface that moves into and out contact with the annular valve seat to close and open the fuel passage;

the annular valve surface defining a portion of a compound annulus defined by the valve member, and the compound annulus being a first annular void that opens into a second annular void;

wherein the compound annulus is defined by a small diameter segment of a cylindrical outer surface of the valve member; and an additional annulus defined by a large diameter segment of cylindrical outer surface;

wherein the electronically controlled valve is a spill valve, and the fuel passage is a spill passage;

a plunger positioned to move in the injector body to displace fuel from a fuel pressurization chamber disposed in the injector body; and the spill passage being disposed in the injector body and extending between the fuel pressurization chamber and a low pressure outlet.

2. A fuel injector comprising:

an injector body with a fuel passage disposed therein that is partly defined by an annular valve seat;

an electronically controlled valve that includes a valve member with an annular valve surface that moves into and out of contact with the annular valve seat to close and open the fuel passage; and the annular valve surface defining a portion of a compound annulus defined by the valve member, and the compound annulus being a first annular void that opens into a second annular void;

wherein the electronically controlled valve is a spill valve, and the fuel passage is a spill passage;

a plunger positioned to move in the injector body to displace fuel from a fuel pressurization chamber disposed in the injector body; and the spill passage being disposed in the injector body and extending between the fuel pressurization chamber and a low pressure outlet;

wherein the valve member includes a threaded bore extending therethrough concentric with the annular valve surface;

a solenoid armature attached to the valve member via a threaded fastener mated to the threaded bore.

3. The fuel injector of claim 2 wherein the compound annulus includes a small annulus that opens into a large annulus.

4. The fuel injector of claim 3 wherein the small annulus has a U-shaped cross section.

5. The fuel injector of claim 4 wherein a center of the small annulus is offset with regard to a center of the large annulus.

6. A fuel injector comprising:

an injector body with a fuel passage disposed therein that is partly defined by an annular valve seat;

an electronically controlled valve that includes a valve member with an annular valve surface that moves into and out of contact with the annular valve seat to close and open the fuel passage; and the annular valve surface defining a portion of a compound annulus defined by the valve member, and the compound annulus being a first annular void that opens into a second annular void;

wherein the electronically controlled valve is a spill valve, and the fuel passage is a spill passage;

a plunger positioned to move in the injector body to displace fuel from a fuel pressurization chamber disposed in the injector body;

the spill passage being disposed in the injector body and extending between the fuel pressurization chamber and a low pressure outlet; and wherein the compound annulus includes a small annulus that opens into a large annulus.

7. The fuel injector of claim 6 wherein the small annulus has a U-shaped cross section.

8. A valve member for a fuel injector control valve comprising a unitary metallic body with a threaded bore therethrough concentric with a cylindrical outer surface;

the cylindrical outer surface defining a compound annulus, and the compound annulus being a first annular void that opens into a second annular void;

a portion of the compound annulus being defined by an annular valve surface;

wherein the compound annulus is defined by a small diameter segment of the cylindrical outer surface; and an additional annulus defined by a large diameter segment of the cylindrical outer surface.

9. The valve member of claim 8 wherein an annular valve seat is located in a transition from the small diameter segment to the large diameter segment.

10. The valve member of claim 9 wherein the large diameter segment extends over a longer length than the small diameter segment.

11. The valve member of claim 10 wherein the compound annulus includes a small annulus that opens into a large annulus.

12. The valve member of claim 11 wherein a center of the small annulus is offset with regard to a center of the large annulus.

13. The fuel injector of claim 12 wherein the small annulus has a U-shaped cross section.

* * * * *